US007658244B2

(12) United States Patent
Mohrmann

(10) Patent No.: US 7,658,244 B2
(45) Date of Patent: Feb. 9, 2010

(54) DEVICE FOR ADVANCING DRILLINGS IN THE GROUND

(75) Inventor: Michael Mohrmann, Adenstedt (DE)

(73) Assignee: Wirth Maschinen-und Bohrgerate-Fabrik GmbH, Erkelenz (DE)

( * ) Notice: Subject to any disclaimer, the term of this patent is extended or adjusted under 35 U.S.C. 154(b) by 537 days.

(21) Appl. No.: 10/522,483

(22) PCT Filed: Jul. 18, 2003

(86) PCT No.: PCT/EP03/07810

§ 371 (c)(1),
(2), (4) Date: Oct. 24, 2005

(87) PCT Pub. No.: WO2004/013449

PCT Pub. Date: Feb. 12, 2004

(65) Prior Publication Data

US 2006/0096784 A1 May 11, 2006

(30) Foreign Application Priority Data

| | | |
|---|---|---|
| Jul. 26, 2002 | (DE) | 102 34 336 |
| Jul. 26, 2002 | (DE) | 102 34 337 |
| Jul. 26, 2002 | (DE) | 102 34 338 |
| Aug. 19, 2002 | (DE) | 102 37 889 |

(51) Int. Cl.
*E21B 10/00* (2006.01)

(52) U.S. Cl. ..... 175/343; 175/371; 175/92; 175/102

(58) Field of Classification Search ..... 175/92, 175/102, 101, 324, 107, 343, 371; 299/31, 299/32, 85.1, 108, 55, 61, 58
See application file for complete search history.

(56) References Cited

U.S. PATENT DOCUMENTS

| | | | | |
|---|---|---|---|---|
| 1,154,137 | A * | 9/1915 | Sletten et al. | 175/97 |
| 3,355,215 | A * | 11/1967 | Wallers et al. | 299/60 |
| 3,383,138 | A | 5/1968 | Scaravilli et al. | |
| 3,963,080 | A | 6/1976 | Walker | |
| 4,332,420 | A | 6/1982 | Coski | |
| 4,492,276 | A * | 1/1985 | Kamp | 175/61 |
| 4,548,443 | A | 10/1985 | Turner | |

(Continued)

FOREIGN PATENT DOCUMENTS

DE 34 16 514 11/1985

(Continued)

OTHER PUBLICATIONS

English Translation of DE4332113.*

(Continued)

*Primary Examiner*—Jennifer H Gay
*Assistant Examiner*—Cathleen R Hutchins
(74) *Attorney, Agent, or Firm*—Darby & Darby

(57) ABSTRACT

A device for driving boreholes in the ground, having a rotationally driven main shaft with a shaft journal whose axis (B) forms an acute angle with respect to the axis (A) of the main shaft. A drill head is mounted such that it can rotate about the axis (B) of the shaft journal and has a circumferential region which runs on a complementary circumferential region, wherein the complementary circumferential region can be set rotating.

16 Claims, 3 Drawing Sheets

U.S. PATENT DOCUMENTS

| | | | | |
|---|---|---|---|---|
| 4,682,661 | A * | 7/1987 | Hughes et al. | 175/215 |
| 4,692,062 | A * | 9/1987 | Akesaka | 405/141 |
| 4,705,120 | A * | 11/1987 | Ebeling et al. | 175/99 |
| 4,736,987 | A | 4/1988 | Lenzen et al. | |
| 4,796,713 | A * | 1/1989 | Bechem et al. | 175/96 |
| 4,880,066 | A * | 11/1989 | Steiginga et al. | 175/75 |
| 5,836,407 | A * | 11/1998 | Leroy | 175/101 |
| 6,561,590 | B2 * | 5/2003 | Sugden | 299/71 |
| 2004/0200640 | A1 * | 10/2004 | Rives | 175/57 |

FOREIGN PATENT DOCUMENTS

| | | |
|---|---|---|
| DE | 43 32 113 | 3/1995 |
| EP | 0 692 612 | 1/1996 |
| JP | 07 324591 | 12/1995 |

OTHER PUBLICATIONS

Patent Abstracts of Japan,Bd. 1996, No. 04, April 30, 1996 & JP 07 324591 A (Fujita Corp), Dec. 12, 1995.

* cited by examiner

DEVICE FOR ADVANCING DRILLINGS IN THE GROUND

BACKGROUND OF THE INVENTION

The invention relates to a device for driving boreholes in the ground, as is disclosed in DE 43 32113 A 1.

Horizontal boreholes, in particular having a borehole diameter of approximately 150 mm to 1 300 mm, and also vertical boreholes are produced in the ground using drilling devices in which a rotation ally driven shaft is mounted rotatably inside a machine housing. A drill head is arranged on the end of the shaft facing the rock face or the borehole bottom.

The drill head can be of various designs depending on the nature of the soil in which the borehole is to be sunk. Difficulties thus frequently arise when the nature of the soil to be removed varies over the length of the drill, For instance, rock drill heads generally equipped with rollers, bits or disks become stuck in soft, for example loamy, soils; by contrast, drill heads displaying good drilling performances in loamy or loose soils rapidly fail "due to high wear on encountering rock or large stones.

In the device disclosed in DE 43 32113 A1, this problem is to be solved by the drill head being caused to make a wobbling movement, with the result that it executes rapid percussive movements with high frequency and, accordingly, with high kinetic energy against the rock face or borehole bottom, yet simultaneously clears the detached drilled material with a high degree of torque and at a low speed, or, if the soil at the rock face is too soft for spalling, peels off soil with a high degree of torque. The percussive effect is particularly intended to significantly increase drill lead-through (drilling progress) where relatively hard formations are encountered.

To produce the wobbling movement, the shaft journal, directed toward the rock face, of the driven main shaft of the device, on which journal the drill head is rotatably mounted, is placed at an acute angle in relation to the axis of the main shaft. If the main shaft is then driven in rotation, the drill head wobbles at a frequency corresponding to the rotational frequency of the main shaft. The amplitude of the wobbling movement is dependent on the distance of the wobble center point and the size of the wobble angle.

To produce the slow intrinsic rotational speed of the drill head, the drill head is provided with an external bevel wheel which runs in a stationary internal bevel wheel during the wobbling movement. As a result, the drill head is set at a rotational speed directed oppositely to the main shaft, specifically with a gear reduction which depends on the configuration of the external bevel wheel relative to that of the internal bevel wheel. Gear reductions of 30:1 to 60:1 should be achievable.

Although the device disclosed in DE 43 32 113 A 1 has been shown to be suitable for loosening soil having a high degree of variation, a disadvantage is that the rotational speed of the drill head is not optimal for many soil conditions, since it is usually too high.

A further disadvantage is that the drill head subjected to a significant degree of wear due to the drilling process is expensive and complicated to manufacture on account of the external bevel wheel, resulting in an increase in the running operating costs of this device.

An additional disadvantage is the fact that the bevel wheels running on one another are subjected to an increased degree of wear as a result of penetrating waste.

A final disadvantage is the fact that large pieces of drilled material in particular are not transported away reliably and the conveying line tends to clog up.

SUMMARY OF THE INVENTION

In a first aspect, the invention is therefore based on the object of improving a device disclosed in DE 43 32 113 A 1 in such a way as to make it suitable for a larger range of different soils. In a second aspect, the device is intended to be developed in such a way that the operating costs associated with its use are reduced. In a third aspect, the duration of use of the device is to be increased. Finally, in a fourth aspect, the drilled material is to be transported reliably away from the drill head space. It goes without saying that the various aspects can also advantageously be realized together in one device.

In the device of the invention, the drill head is further driven in rotation by the fact that it has a circumferential region which runs on a complementary circumferential region during the rotation of the main shaft. According to the invention, the rotation of the drill head caused by this running action is influenced only in terms of its speed of rotation through the fact that the complementary circumferential region can itself rotate. Depending on the direction of rotation of the complementary circumferential region, and given a constant speed of the main shaft, there is thus produced an increase or reduction in the resulting rotational speed of the drill head.

It is possible for the complementary circumferential region and the circumferential region running on it to be switched off in any way that ensures a running action during the operation. However, it is preferable, due to the simplicity of the manufacture and the operational reliability, for the circumferential region to comprise an external tooth system and for the complementary circumferential region to comprise an internal tooth system.

The complementary circumferential region is preferably formed by a hollow wheel which is arranged concentrically with respect to the main shaft axis and which, according to the invention, can rotate.

In the case of the device disclosed in DE 43 32 113 A 1, it has been shown in the past that the ratio between the wobbling frequency and the rotational frequency of the drill head is not optimal for a multiplicity of applications. A lower-ratio rotational speed of the drilling head would usually be more advantageous for the drilling progress. A preferred embodiment of the device according to the invention therefore provides that the complementary circumferential region can be rotated by means of a planet gear mechanism in engagement with the main shaft. This embodiment has the advantage that, compared with the generic device, it requires no further, expensive drive motors. Furthermore, this embodiment is notable for a particularly high operational reliability.

However, it is also possible to set the complementary circumferential region into rotation by means of a separate drive independently of the main drive, i.e. not to couple the complementary circumferential region and the main shaft. It is particularly preferable for the separate drive then to be designed so that it can be controlled or regulated, which makes it possible during operation to tailor the ratio between the drill head speed and the wobbling frequency to the type of soil present in the particular instance.

In order to avoid overloading of the rotary drive of the main shaft in particular and to reduce wear on the drill head in particular, it is preferable to provide means for controlling or regulating the advance of the drill as a function of the output of the rotary drive of the main shaft. This design provides a continuous optimum ratio between the advance and the drive power of the drill head.

If the drill is advanced and the main shaft is driven in rotation by means of a hydraulic medium, means then regarded as preferable are ones which control or regulate relative to one another the hydraulic pressures for effecting the advance of the drill and for driving the main shaft in rotation. If, for example, the pressure at the motor is not high enough for the rotary drive, the hydraulic pressure for effecting the advance of the drill is reduced until the operating pressure at the drive motor is sufficient for effecting the rotary drive. If the pressure at the drive motor is too high, the hydraulic pressure for effecting the advance of the drill is reduced until the desired pressure at the rotary motor is likewise established. As a result, this design ensures optimum utilization of the device by achieving the greatest possible drilling progress without subsequent permanent manual control measures having to be taken for this purpose.

In another embodiment of the device, the drill head is of multipart design such that it is possible to detach from the bearing part the tool part subjected to a high degree of wear due to the friction on the soil to be loosened. This measure means that the operating costs associated with the device in which the drill head is caused to make a wobbling movement during its revolution are not higher than those applying to a conventionally operating device, since there is no need to exchange the bevel wheel, which is expensive to manufacture, and the bearing components of the drill head in the event of a worn drill head. If, as preferred, the drill head is split into two parts, namely into a central bearing part and a tool part fastened to the central bearing part, there is a significant reduction in the conversion times associated with a change of tool part as compared with changing the entire drill head in the case of conventional devices. The operating costs are again lowered as a result of the increase in time efficiency achieved thereby and of the simultaneous increase in drilling progress per unit time.

Particular preference is given to a design of the drill head in which the tool part is fastened to the bearing part by screws. These are preferably arranged with uniform distribution uniformly over a pitch circle of the bearing part.

In another embodiment a sealing arrangement is provided that at least substantially seals the bearing arrangement for the drill head and prevents wear-increasing waste from reaching the region in which the circumferential region runs on the complementary circumferential region.

In a preferred embodiment of the device according to the invention, the sealing arrangement comprises an elastic bellows. The bellows is used to compensate the radial relative movement between the bearing part of the drill head and a flange which does not wobble but revolves at the speed of the scraper disk. The flange is preferably sealed relative to the housing of the device by a sliding ring seal.

By designing the drill head and the receiving end of the conveying line so that the wobbling movement of the drill head mechanically transports drilled material that is situated prior to the receiving end into the conveying line, results in the drilled material being transported away in a considerably more effective manner than is the case in the prior art.

If, as preferred, the drill head is provided at its side remote from the rock face with at least one projection which, as a result of the wobbling movement, at least virtually penetrates the receiving end of the conveying line, the drilled material is introduced particularly effectively into the conveying line and is further transported by means of the recurring, mechanical pressure in the conveying unit.

In order to avoid a situation where, despite the conveyance being more effective, the conveying process may be brought to a halt or even to a complete standstill, means for reducing the size at least of large drilled pieces are preferably provided in the region adjoining the receiving end of the conveying line.

These size reducing means may comprise actively operating, i.e. self-driven, stone crushers. However, an embodiment in which the means intended for crushing comprise breaker ribs extending to a substantial degree into the cross section of the conveying line is surprisingly effective and can be produced simply and is therefore preferred.

The effectiveness of the conveying line, i.e. the excavation rate achieved with it, is again increased if the receiving end has a partially annular design in cross section. This is because it is then possible to arrange the receiving end in the borehole along the inner circumference of the borehole and symmetrically with respect to its deepest point, so that there is no need for any height differences to be overcome for the purpose of "charging" the receiving end.

The request rate may again be increased if the device additionally comprises means for blowing conveying air into the drill head space, as is known for pneumatic transporting from the prior art.

BRIEF DESCRIPTION OF THE DRAWING

The drawing provides a schematic representation of exemplary embodiments of the device according to the invention. In the drawing.

DETAILED DESCRIPTION OF THE INVENTION

Figure 1:
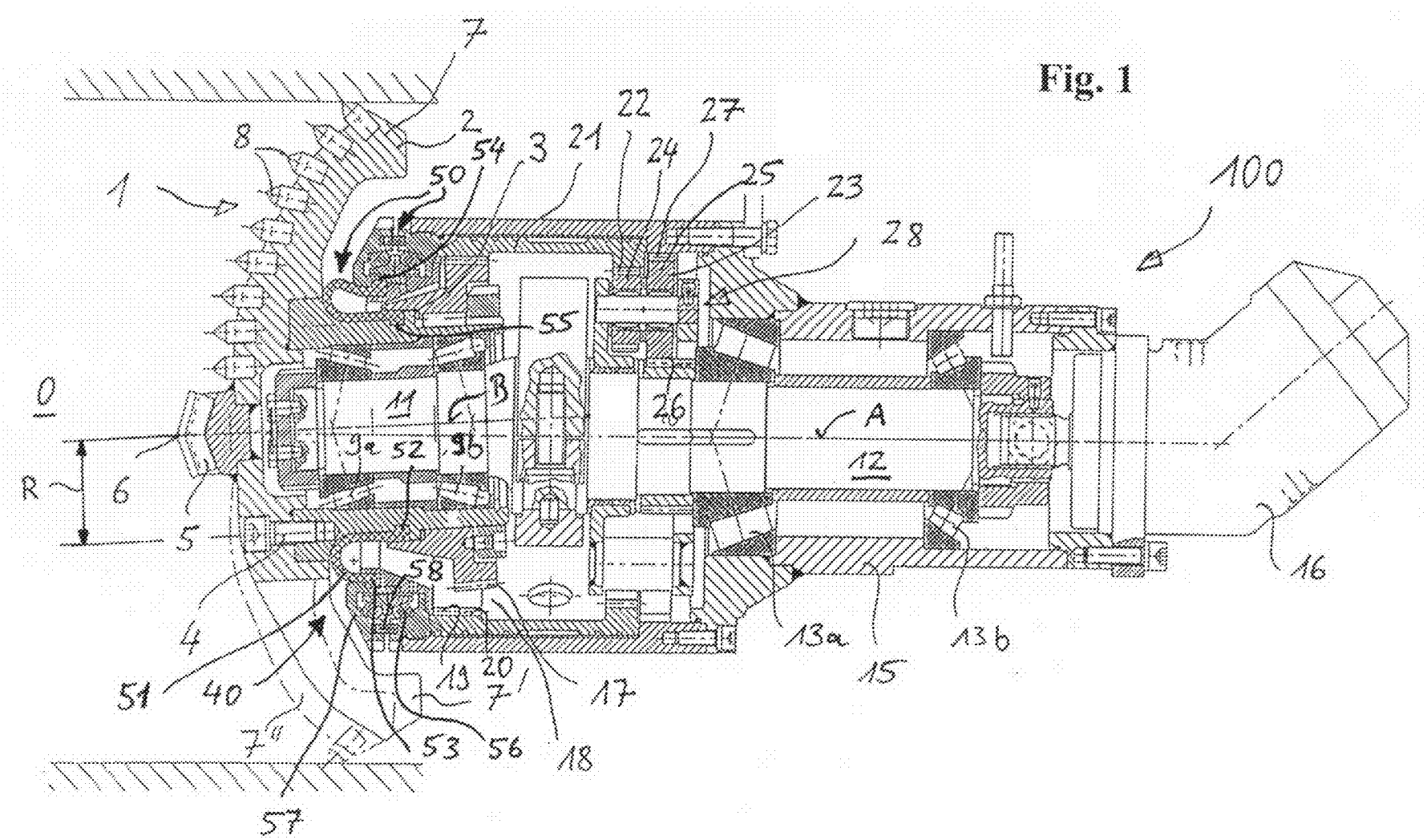
FIG. 1 shows a longitudinal section through a first embodiment.

The device designated overall by 100 comprises a drill head 1 having a tool part 30, designed as a scraper disk 2, and a bearing part 3. The scraper disk 2 and the bearing part 3 are fastened to one another by a plurality of cylindrical screws 4, only one of which is shown in the drawing. The cylindrical screws 4 are arranged with uniform distribution on a pitch circle having the radius R. Splitting the drill head 1 into two parts makes it possible for the tool part 30 subjected to wear to be disassembled on the building site once the wear limit has been reached by unscrewing the screws 4, and replaced by a new or rebuilt tool part.

The scraper disk 2 is provided with a central cutter 5 whose tip 6 is situated on the axis of rotation A of the drill head. In the embodiment shown, the scraper disk 2 has three arms 7, 7', 7" extending radially outward, of which the arm 7 shown at the top of the drawing is equipped with a plurality of bits 8.

Via the bearing part 3, and by means of a bearing arrangement 40 comprising taper roller bearings 9*a*, 9*b*, the drill head 1 is mounted such that it can rotate on a shaft journal 11 of a main shaft 12. The shaft journal 11 has a substantially cylindrical external circumferential surface and is integrally formed on the main shaft 12 so that its axis B encloses an acute angle w of approximately 5° with the axis of rotation A.

The main shaft 12 for its part is mounted so that it can rotate about the axis of rotation A in a machine housing 15 by means of taper roller bearings 13*a*, 13*b* and is driven in rotation by a hydraulic motor 16 flanged on at the end of the shaft. The part of the bearing part 3 that faces the scraper disk 2 is designed as a gearwheel, termed wobbling edge 17 in the text that follows, which is arranged concentrically with respect to the axis B of the shaft journal 11, and is thus designed as the circumferential region 18 which, during rotation of the main shaft 12, runs in an internal tooth system 20 acting as a complementary circumferential region 19.

The internal tooth system 20 is formed on a hollow wheel 21 arranged concentrically with respect to the main shaft axis and mounted rotatably relative to said axis.

At the end opposite the inner tooth system 20, the hollow wheel has a further internal tooth system 22 which is part of a planet gear mechanism designated overall by 28. The tooth systems of the parts of smaller diameter 24 of planet gearwheels 23 engage in the internal tooth system. The parts 25 of larger diameter of the planet gearwheels 23 engage by way of their tooth system in an external tooth system 26 provided on the main shaft 12, and also in an internal tooth system 27 provided in the machine housing 15. As a result, while the main shaft 12 is being driven in rotation the planet gearwheels orbit the axis of rotation A in the same direction of rotation. In the process, the hollow wheel 21 is set rotating in the opposite direction to the drill head 1, the rotation of the latter being brought about by the wobbling wheel 17 running on the internal tooth system 20. It goes without saying that by selecting the ratios in the planet gear mechanism 28 it is possible to predetermine the speed of rotation of the hollow wheel 21 relative to the main shaft 12 and thus, as a result, the ratio of the wobbling frequency to the rotational frequency of the drill head.

For the purpose of sealing the bearing arrangement 40 and/or the interior of the machine housing 15 relative to the drill head space O, there is provided a sealing arrangement 50. The sealing arrangement 50 comprises an elastic bellows 51 with an approximately V-shaped design in cross section. The bellows 51 is installed in such a way that its concave side is directed toward the drill head space O.

The annular, free ends of the bellows 51 each have outwardly directed thickened portions 52, 53. One thickened portion 52 rests in a complementarily designed annular groove 54 of the bearing part 3. The other thickened portion 53 rests in an annular groove 55 of a ring 57 mounted so as to be able to rotate relative to the machine housing 15 by means of a ball bearing 56. The bellows 51 therefore absorbs the movement component of the drill head 1 relative to the machine housing 15 that has been caused by the wobbling movement.

Arranged between the ring 57 revolving at the wobbling frequency and the end of the machine housing that faces the ring is a sliding ring seal 58 which prevents contaminants from getting into the ball bearing 56.

Figure 2:
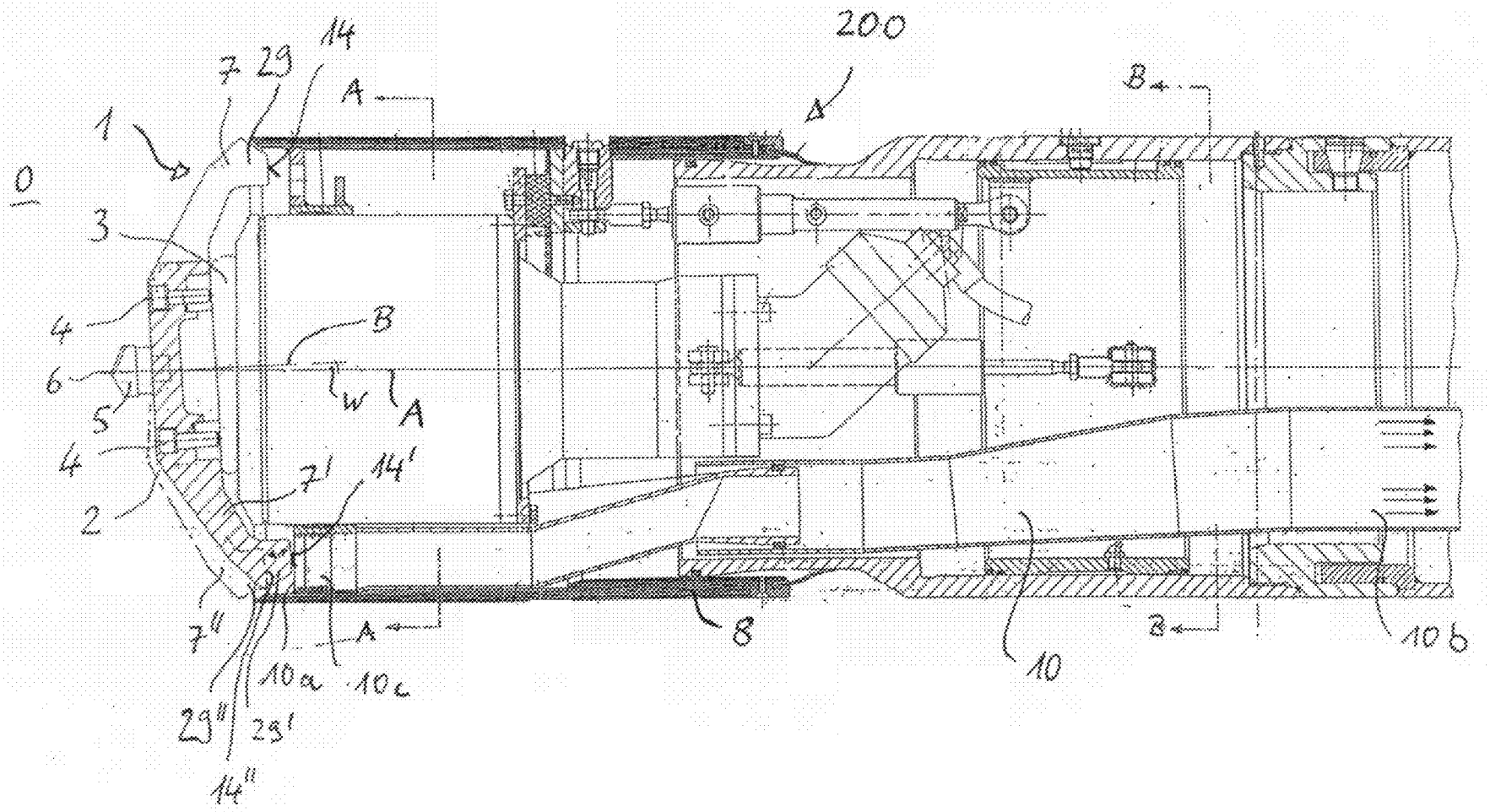
FIG. 2 shows a longitudinal section through a second embodiment.
Figure 4:
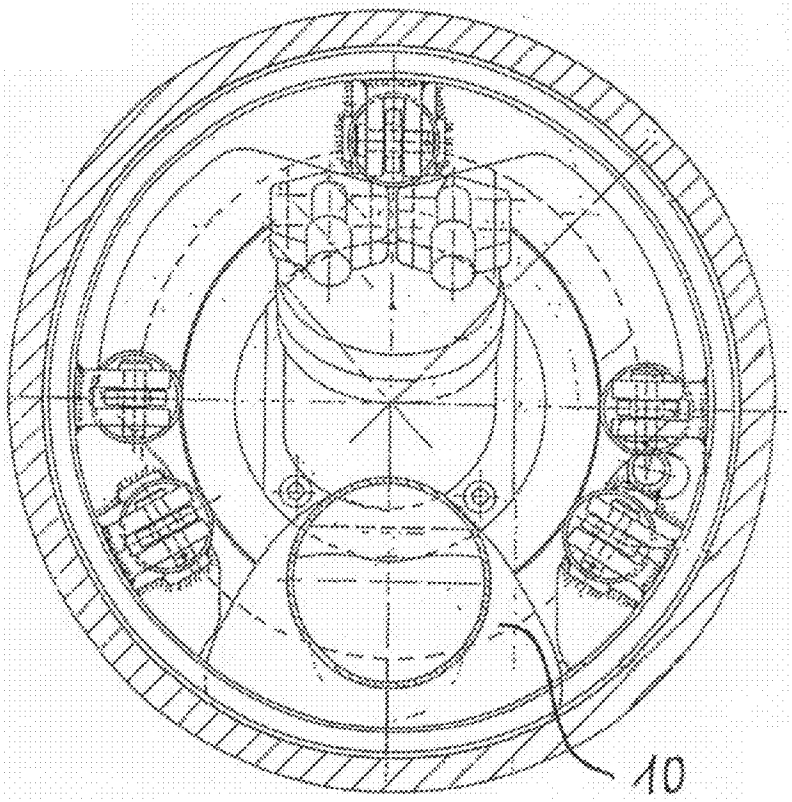
FIG. 4 shows a view along section line B-B in FIG. 2.

The device designated overall by 200 in FIG. 2 in turn comprises a drill head 1 having a scraper disk 2 and a bearing part 3. The scraper disk 2 and the bearing part 3 are fastened to one another by a plurality of cylindrical screws 4, of which only two are shown in the drawing.

The scraper disk 2 is provided with a central cutter 5 whose tip 6 is situated on the axis of rotation A of the drill head. In the embodiment shown, the scraper disk 2 has three arms 7,7',7" extending radially outward.

Via the bearing part 3, and by means of bearings (not shown in the drawing), the drill head 1 is mounted such that it can rotate on a shaft journal of a main shaft. The shaft journal, having a substantially cylindrical external circumferential surface, is formed integrally on the main shaft so that its axis B encloses an acute angle w with the axis of rotation A.

The main shaft for its part is mounted such that it can rotate about the axis of rotation A in a machine housing 8 and is driven in rotation by a hydraulic motor.

Figure 3:
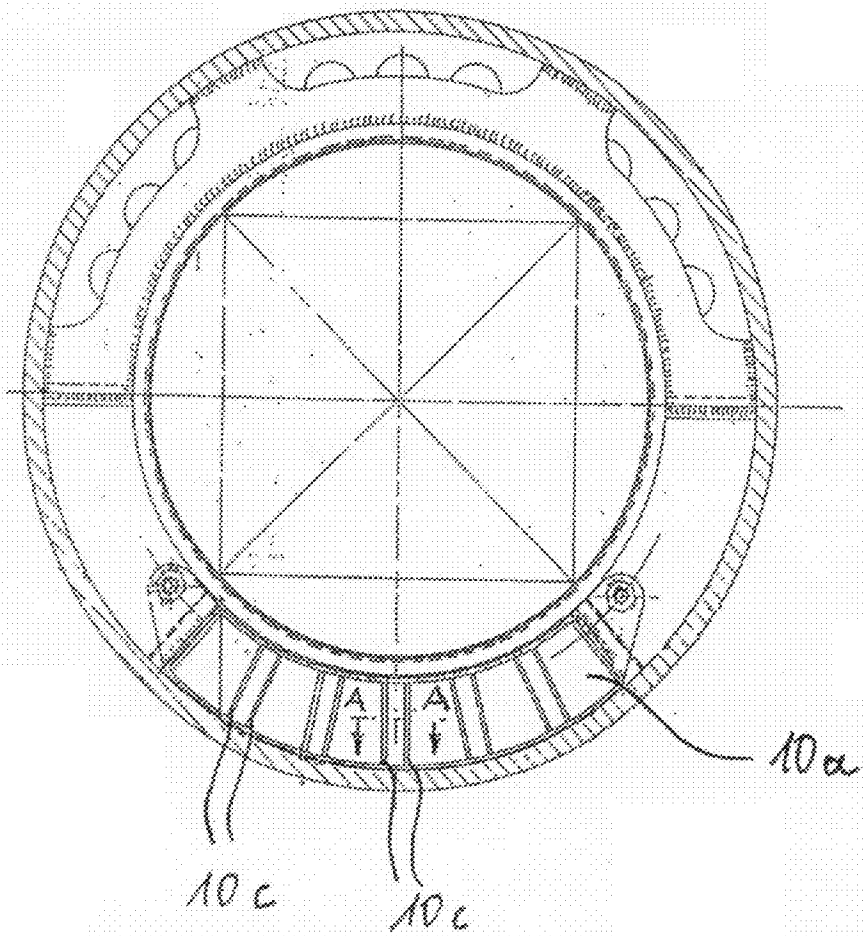
FIG. 3 shows a view along section line A-A in FIG. 2.

Detached drilled material is transported away using a conveying channel 10 whose rear region 10*b* of circular internal cross section is flattened off toward the drill head space O in order finally, in a receiving end 10*a* having a partially annular cross section, to lead into the drill head space O (see, in particular, FIGS. 2 and 3).

Provided in the region of the receiving end 10*a* are breaker ribs 10*c* which extend approximately radially, as can be discerned in FIG. 2. The breaker ribs 10*c* are arranged in pairs in each case, in such a way that a small spacing separating two adjacent breaker ribs 10*c* is followed by a larger spacing. The pitch of the ribs 10*c* is selected in such a way that the drilled material awaiting removal is crushed to such an extent that it is able to be transported away through the conveying channel 10 without problems.

For the purpose of mechanically feeding drilled material into the receiving end 10*a* of the conveying channel 10, the ends of the arms 7, 7', 7" of the scraper disk 2 are provided with continuations 29, 29', 29" whose rear-facing faces 14, 14', 14" are designed as conveying faces for the drilled material. The faces 14, 14', 14" likewise serve as striking faces for the purpose of breaking the drilled material. The wobbling frequency of the scraper disk is synchronized with the speed of rotation of the scraper disk in such a way as to cause drilled material to be pushed mechanically into the receiving end 10*a* of the conveying line 10 during a pass of one of the arms 7, 7', 7".

To assist the conveying process, the device according to the invention comprises an inlet for blowing conveying air into the drill head space O. The inlet is not discernible in the drawing. A flow of air symbolized by the arrow P is generated in the conveying line as a result of blowing air into the drill head space.

The invention claimed is:

1. A device for driving boreholes in the ground, having a rotationally driven main shaft (12) disposed in a housing (15), comprising a shaft journal (11) whose axis (B) forms an acute angle (w) with respect to the axis (A) of the main shaft (12), and having a drill head (1) which is mounted such that the drill head can rotate about the axis (B) of the shaft journal (11) and has a circumferential region (18) which runs on a complementary circumferential region (19) so that the drill head is shifted in rotational speed reciprocal to the main shaft, wherein the complementary circumferential region (19) is rotatable relative to the housing (15).

2. The device as claimed in claim 1, wherein the circumferential region (18) has an external tooth system and the complementary circumferential region (19) has an internal tooth system.

3. The device as claimed in claim 1, wherein the complementary circumferential region (19) is formed by a hollow wheel (21) arranged concentrically with respect to the axis (A) of the main shaft (12).

4. The device as claimed in claim 1, wherein the complementary circumferential region (19) can be set rotating by means of a planet gear mechanism (28) in engagement with the main shaft (12).

5. The device as claimed in claim 1, wherein the complementary circumferential region (19) can be set rotating by means of a separate drive independently of the main shaft (12).

6. The device as claimed in claim 5, wherein the separate drive can be controlled or regulated.

7. The device as claimed in claim 1, wherein means are provided using which the advance of the drill can be set rotating as a function of the output of the rotary drive of the main shaft.

8. The device as claimed in claim 7, wherein the input drive can be controlled or regulated.

9. The device as claimed in claim 1, further comprising means for controlling or regulating the advance of the drill as a function of the output of the rotary drive of the main shaft.

10. The device as claimed in claim 9, in which the drill is advanced and the main shaft is driven in rotation using a hydraulic medium, wherein means are provided which control or regulate the hydraulic pressures for effecting the advance of the drill and for driving the main shaft in rotation.

11. The device for driving boreholes in the ground as claimed in claim 1, having a rotationally driven main shaft (12) comprising a shaft journal (11) whose axis (B) forms an acute angle (w) with respect to the axis (A) of the main shaft (12), and having a drill head (1) which is mounted such that the drill head can rotate about the axis (B) of the shaft journal (11) and has a circumferential region (18) which runs on a complementary circumferential region (19), wherein the drill head (1) is of multipart design such that the part of the drill head subjected to wear can be separated from the part of the drill head that causes the drill head to bear on the shaft journal (11).

12. The device as claimed in claim 11, wherein the drill head (1) comprises a central bearing part (3) and a tool part (30) fastened detachably thereto.

13. The device as claimed in claim 12, wherein the tool part (30) is fastened to the bearing part (3) by means of screws uniformly distributed over a pitch circle.

14. The device for driving boreholes in the ground as claimed in claim 1, having a rotationally driven main shaft (12) comprising a shaft journal (11) whose axis (B) forms an acute angle (w) with respect to the axis (A) of the main shaft (12), and having a drill head (1) working in a drill head space (O), which is mounted such that the drill head can rotate about the axis (B) of the shaft journal (11) in a bearing arrangement (40) and has a circumferential region (18) which runs on a complementary circumferential region (19), wherein a sealing arrangement (50) is provided which at least substantially seals the bearing arrangement (40) relative to the drill head space (O).

15. The device as claimed in claim 14, wherein the sealing arrangement (50) comprises an elastic bellows (51).

16. The device as claimed in claim 14, wherein the sealing arrangement comprises a sliding ring seal.

* * * * *